United States Patent [19]

Okazaki

[11] 4,329,858

[45] May 18, 1982

[54] AUTOMATIC DEHYDRATOR

[75] Inventor: Shizuo Okazaki, Aichi, Japan

[73] Assignee: Tokyo Shibaura Denki Kabushiki Kaisha, Kawasaki, Japan

[21] Appl. No.: 153,135

[22] Filed: May 27, 1980

[30] Foreign Application Priority Data

Jul. 30, 1979 [JP] Japan ..... 54-96995

[51] Int. Cl.[3] ..... D06F 29/00

[52] U.S. Cl. ..... 68/12 R; 68/23.5; 68/26; 68/148

[58] Field of Search ..... 68/12 R, 23.5, 26, 148, 68/205 R; 8/158

[56] References Cited

U.S. PATENT DOCUMENTS 3,359,578 12/1967 Morey et al. ..... 68/12 R X 3,620,053 11/1971 Dunn ..... 68/23.5

*Primary Examiner*—Philip R. Coe

*Attorney, Agent, or Firm*—Cushman, Darby & Cushman

[57] ABSTRACT

An automatic dehydrator having a timer for controlling a dehydrating operation which includes a dehydrating rinse process and a dehydration process and a select switch for selecting a combination of the dehydrating rinse process and the dehydration process or a dehydrating rinse process alone to prevent creasing of clothes.

6 Claims, 22 Drawing Figures

AUTOMATIC DEHYDRATOR

This invention relates to an automatic dehydrator, more particularly to an improvement in an automatic dehydrator in which a dehydrating rinse process and a dehydration process are controlled by a timer and a select switch.

Recently, an automatic dehydrator which has an electromagnetic valve for controlling water supply to a dehydrating basket and a timer for controlling the valve and a motor for rotating the basket has been developed. In this dehydrator, the timer controls the valve and the motor to carry out the dehydrating operation. The operation includes a "dehydrating rinse" process in which the motor is intermittently rotated while water is supplied and a "dehydration" process in which the motor is continuously rotated without water being supplied. Then, the dehydrator is operated for the first time to carry out the "dehydrating rinse" process and continuously to carry out the "dehydration" process. However, this dehydrator has the drawback that clothes, especially shirts, are creased by the continuous high-speed rotation of the basket. Then, the operator must keep watching during the two processes.

It is an object of this invention to provide an automatic dehydrator which can avoid creasing clothes.

It is another object of this invention to provide an automatic dehydrator which has a select switch for selecting combination of a dehydrating rinse process and a dehydration process or a dehydrating rinse process alone.

In this invention, a motor for rotating the basket is controlled by a timer and a select switch. The operator can select the combination of a dehydrating rinse process and dehydration process or the dehydrating rinse process alone to prevent creasing of clothes.

The foregoing objects and other objects as well as the characteristic features of the invention will beome more apparent and more readily understood by the following description and the appended claims when read in conjunction with the accompanying drawings.

Figure 10:
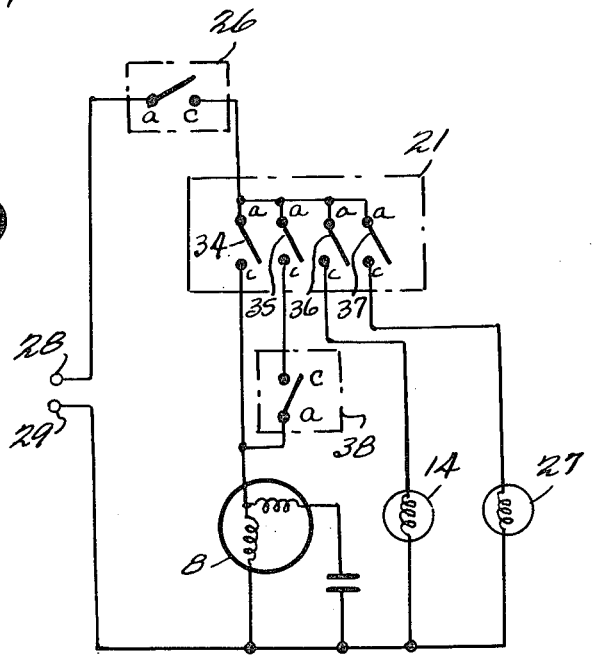
Figure 13:
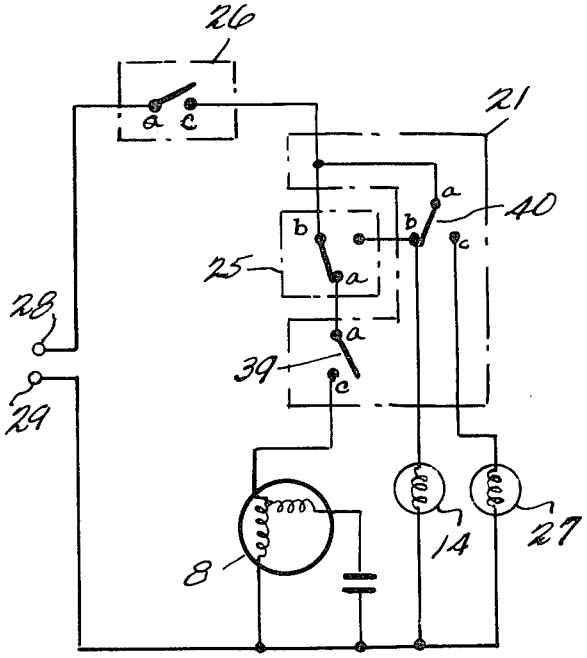
Figure 4:
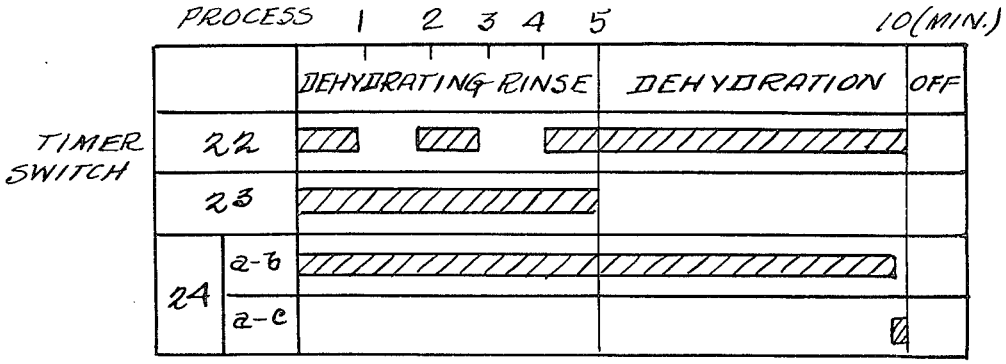
Figure 5A:
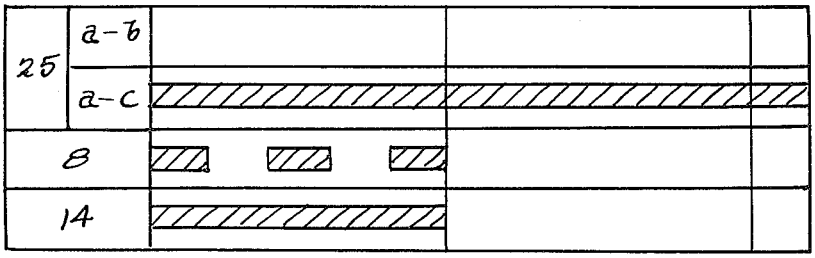
Figure 5B:
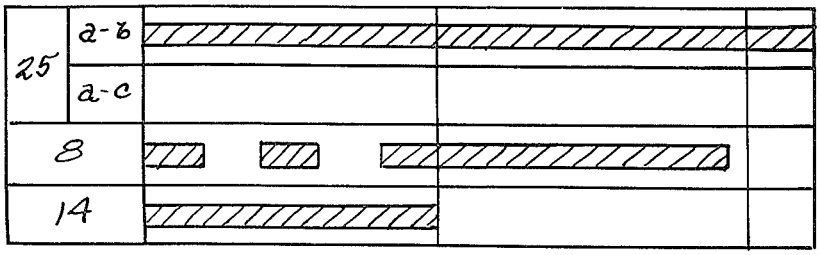
Figure 6:
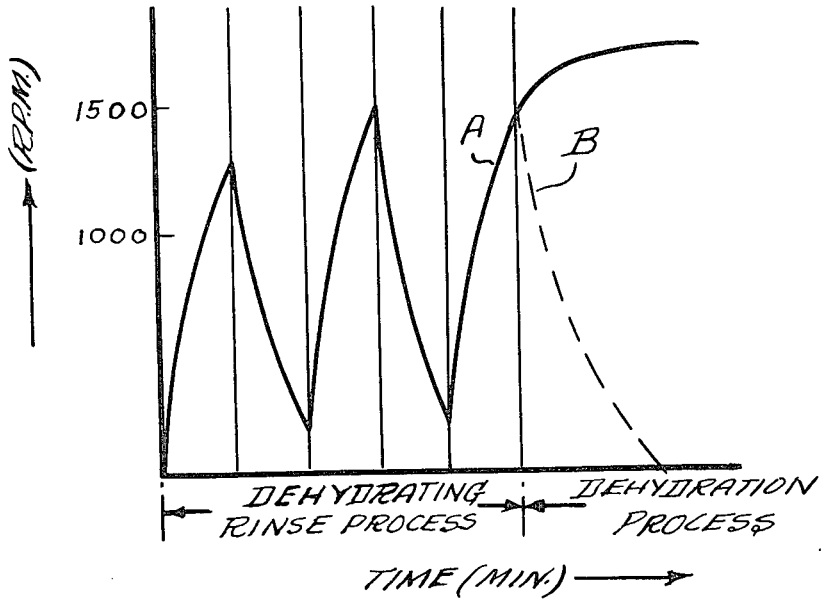
Figure 7:
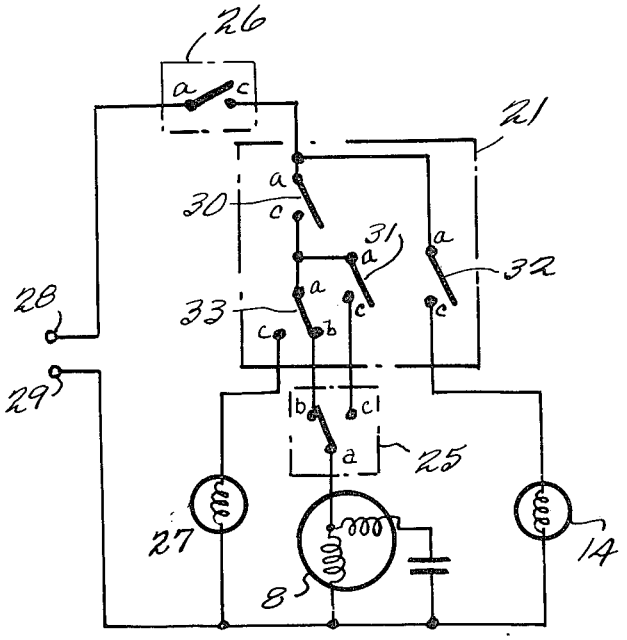
Figure 8:
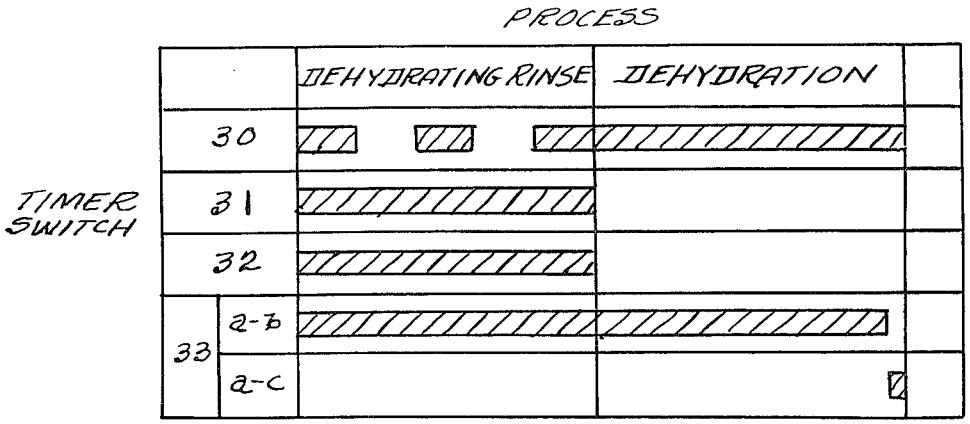
Figure 9A:
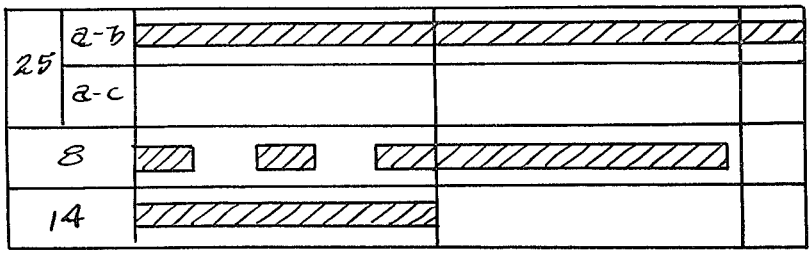
Figure 9B:
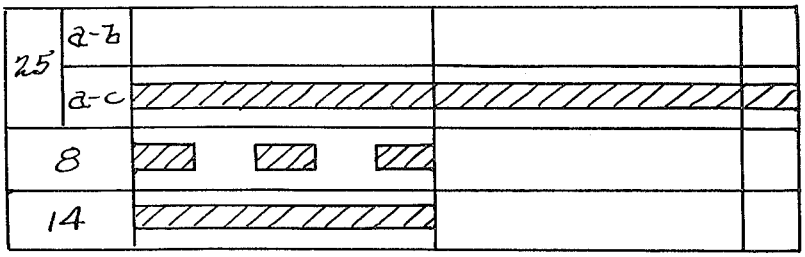
Figure 11:
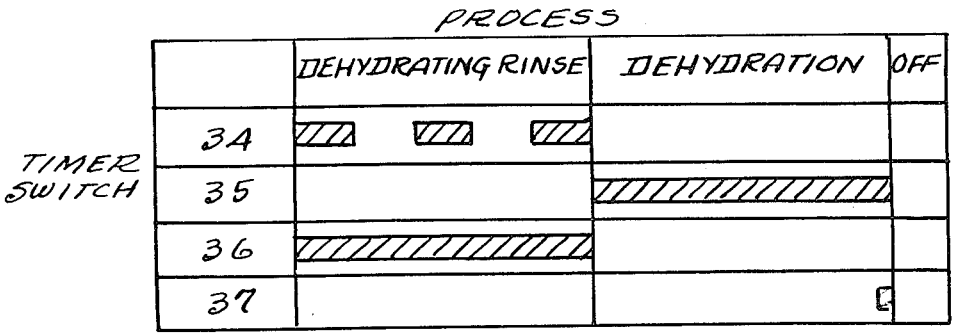
Figure 12A:
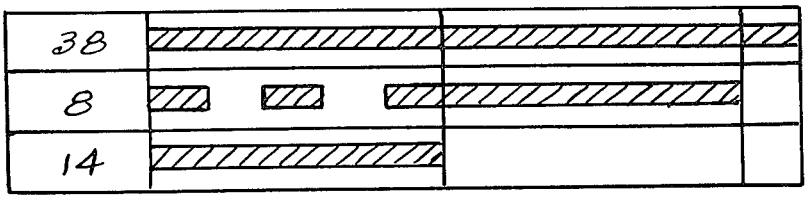
Figure 12B:
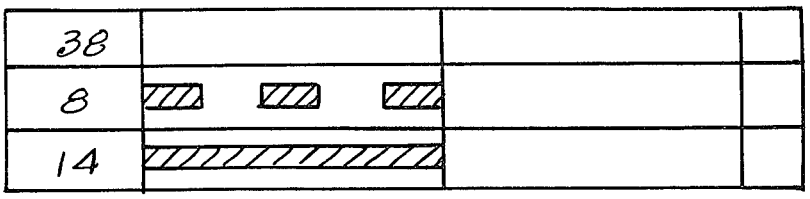
Figure 14:
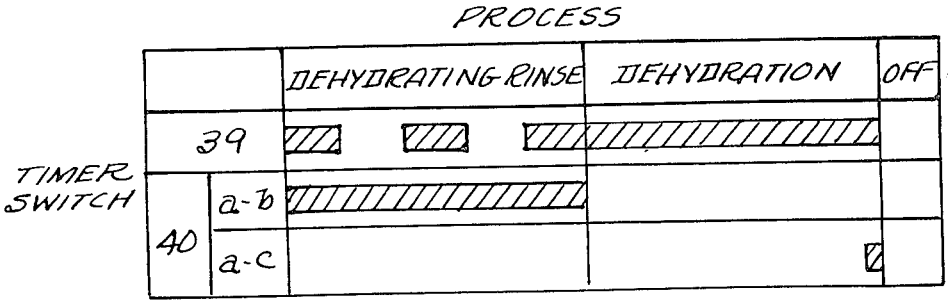
Figure 15A:
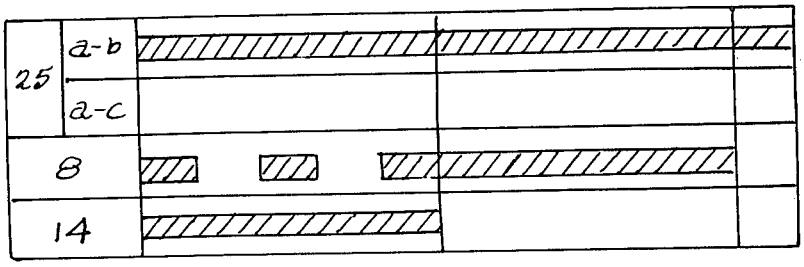
Figure 15B:
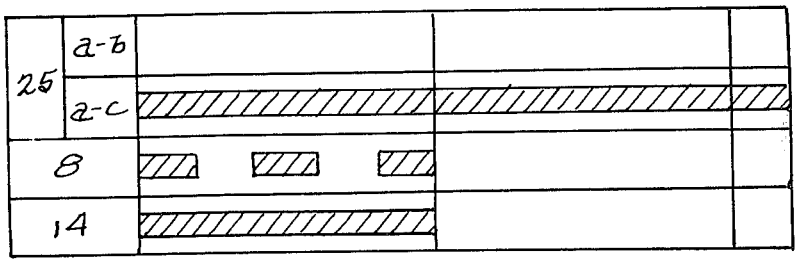
Figure 16:
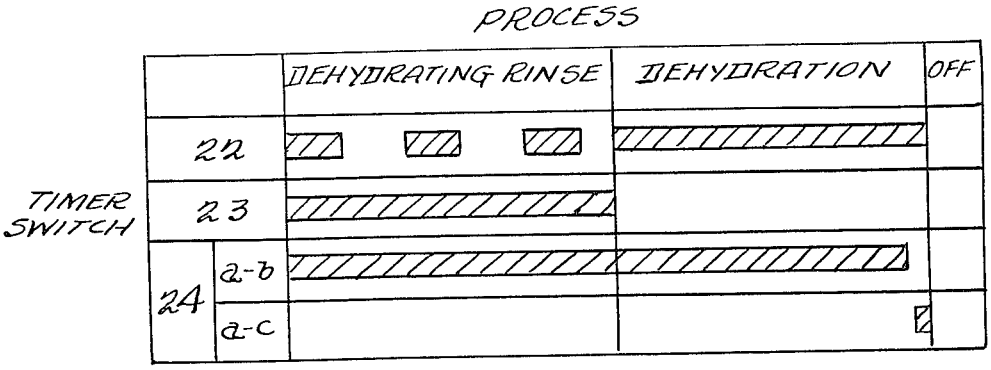
Figure 17A:
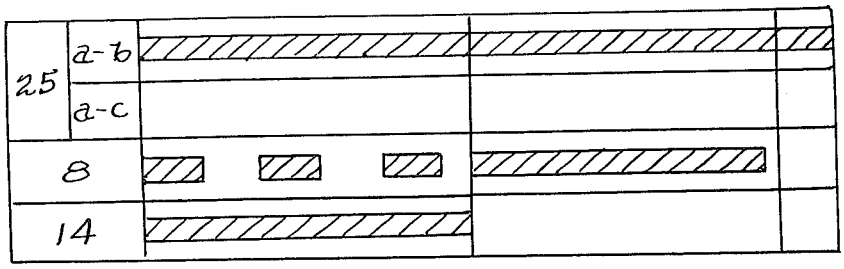
Figure 17B:
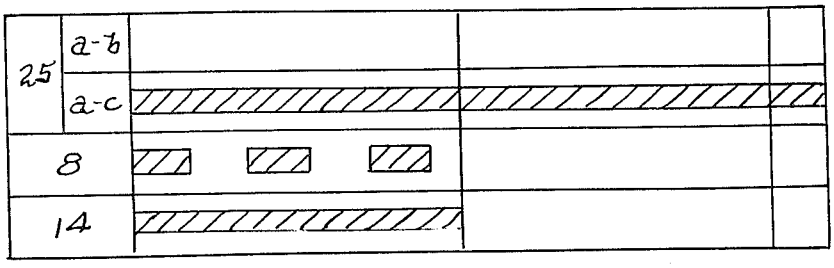

FIG. 4, FIG. 5*a* and FIG. 5*b* are the timing charts according to the first embodiment of the invention;

FIG. 6 is a diagram between time and a revolution per minute of a motor according to the invention;

FIG. 7 is a wiring diagram according to the second embodiment of the invention;

FIG. 8, FIG. 9*a* and FIG. 9*b* are the timing charts according to the second embodiment of the invention;

FIG. 10 is a wiring diagram according to the third embodiment of the invention;

FIG. 11, FIG. 12*a* and FIG. 12*b* are the timing charts according to the third embodiment of the invention;

FIG. 13 is a wiring diagram according to the fourth embodiment of the invention;

FIG. 14, FIG. 15*a* and FIG. 15*b* are the timing charts according to the fourth embodiment of the invention; and FIG. 16, FIG. 17*a* and FIG. 17*b* are the timing charts according to the fifth embodiment of the invention.

Now there will be described a first embodiment of the invention according to FIG. 1 to FIG. 6. In a outer case 1, a dehydrating tub 2 and a washing tub 3 are supported at the top portion of outer case 1 by hanging on the edge thereof. A dehydrating basket 4 is rotatably mounted in dehydrating tub 2. A stirring blade 5 is rotatably mounted on the bottom of washing tub 3 and driven by a motor 6 through a belt transmission 7. A motor 8 rotates basket 4 through a coupling 9. A drain hose 10 is connected to the bottom holes of washing tub 3 and dehydrating tub 2. An electromagnetic valve 11 for draining water is located in drain hose 10 near the bottom hole of washing tub 3. A water supply pipe 12 is located in an operating box 13 which is mounted on outer case 1. The supply of the water to washing tub 3 through a conduit 15 and to dehydrating tub 2 through a conduit 16 is changed by electromagnetic valve 14. An outer lid 17 is removably mounted on dehydrating tub 2. A cover 18 has an opening for throwing the clothes to be washed therethrough. A flood vessel 19 which doubles as an inner lid is rotatably mounted by hinge 19*a* for closing the opening of cover 18. A bellows 16*a* connects between an inlet hole 19*b* of flood vessel 19 and the end of conduit 16. A case 20 is mounted on the inner bottom of basket 4 and has holes 20*a* on the periphery thereof. The opening of case 20 faces to an opening 19*c* of flood vessel 19.

Figure 1:
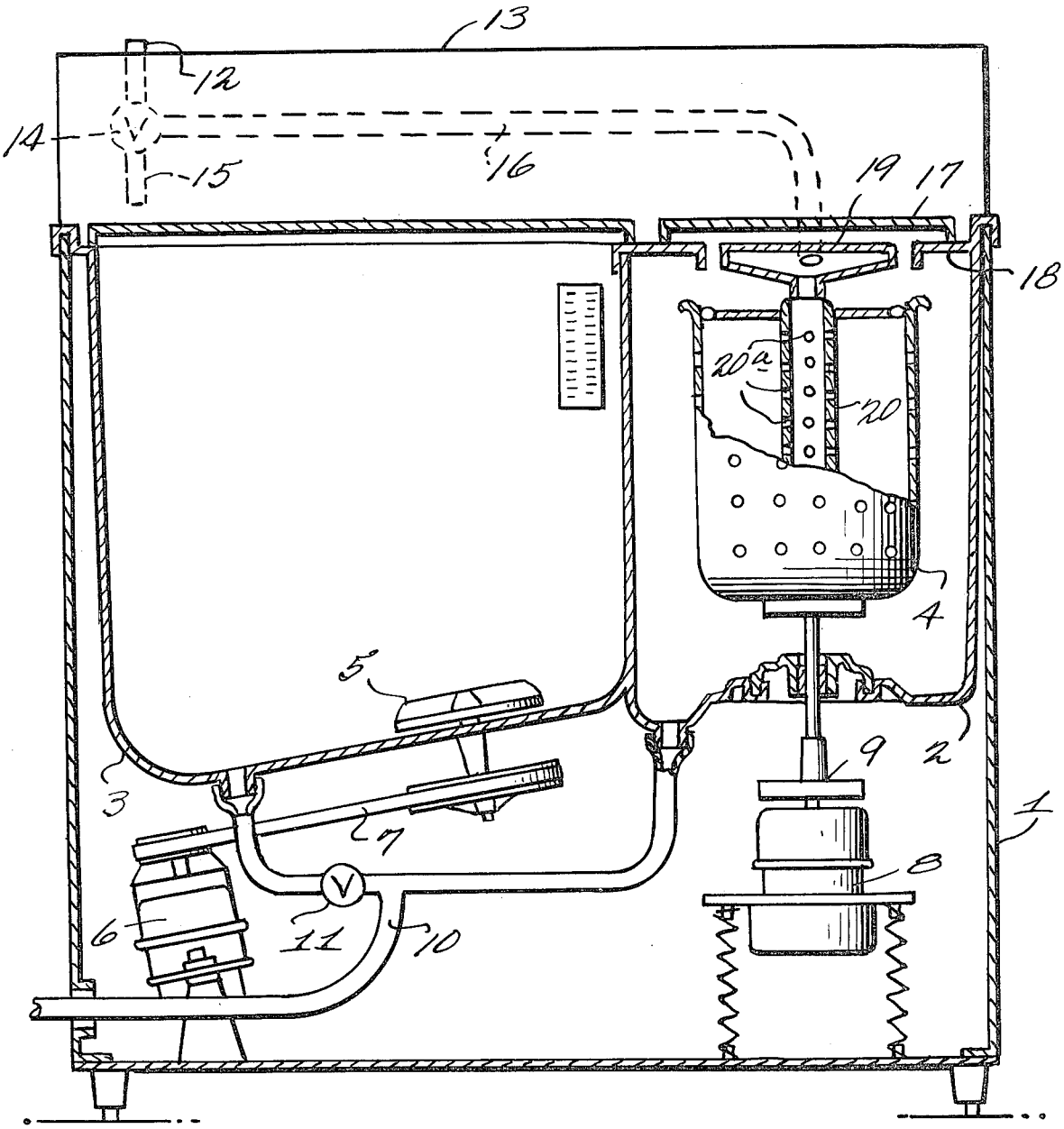
FIG. 1 is a sectional view of an automatic dehydrator which is applied to an automatic washer according to this invention.
Figure 2:
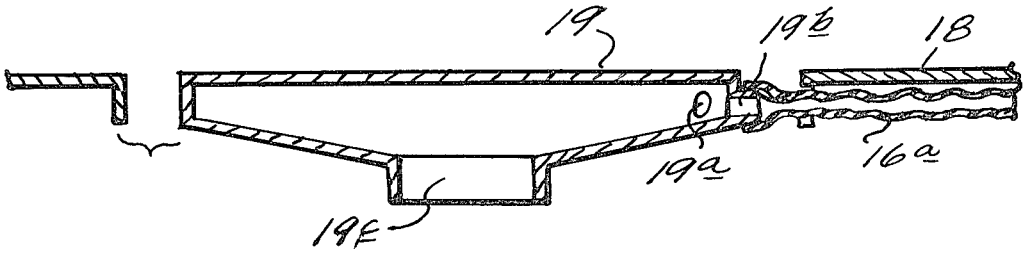
FIG. 2 is a fragmentary enlarged sectional view of a flood vessel taken along line 2—2 of FIG. 1, in the direction of the arrows.
Figure 3:
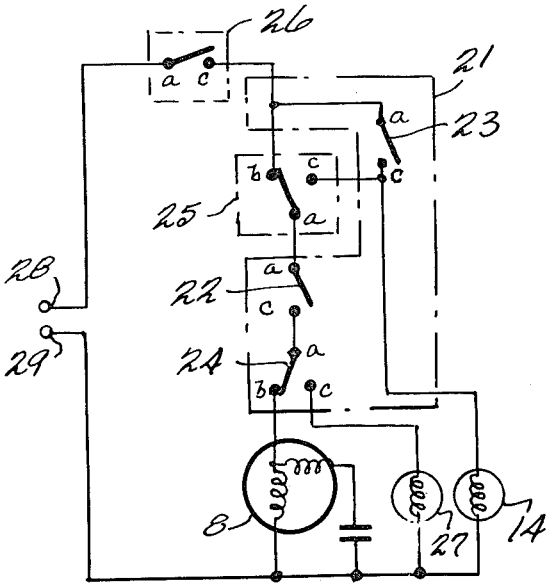
FIG. 3 is a wiring diagram according to the first embodiment of the invention.

A dehydrating timer 21 is located in operating box 13. Timer 21 includes cams (not shown) which are rotated by a spring driver (also not shown) and first, second and third timer switches 22, 23 and 24 which are opened and closed by the cams as shown in FIG. 3. FIG. 4 shows the condition of timer switches 22, 23 and 24 in which the oblique-lines show the closed condition and the blanks show the open condition. In this embodiment, first timer switch 22 closes intermittently, for example, every one minute for five minutes of "dehydrating rinse" process of timer 21 and closes during all five minutes of "dehydration" process of timer 21. Second timer switch 23 closes for all five minutes of "dehydrating rinse" process of timer 21 and opens for all five minutes of "dehydration" process of timer 21. Third timer switch 24 closes a contact (a-c) thereof for the last fifteen seconds of "dehydration" process of timer 21 and closes a contact (a-b) thereof during the other time of "dehydration" process and all the time of "dehydrating rinse" process of timer 21. A select switch 25 which is mounted on operating box 13 is operated manually. A lid switch 26 is closed with the closing of outer lid 17 of dehydrating tub 2. A pair of terminals 28 and 29 are connected to a power source (not shown). Motor 8 is connected between terminal 29 and a stationary contact (b) of third timer switch 24. A buzzer 27 for indicating the end of the "dehydration" is connected between terminal 29 and another stationary contact (c) of third timer switch 24. Electromagnetic valve 14 is connected between terminal 29 and a stationary contact (c) of second timer switch 23 and select switch 15. A movable contact (a) of lid switch 26 is connected to terminal 28 and a stationary contact (c) thereof is connected to a movable contact (a) of second timer switch 23 and to another stationary contact (b) of select switch 25. A movable contact (a) of first timer switch 22 is connected to a movable contact (a) of select switch 25 and a stationary contact (c) thereof is connected to a movable contact (a) of third timer switch 24.

The operation of this embodiment will now be described together with FIG. 4, FIG. 5*a*, FIG. 5*b* and FIG. 6. FIG. 5*a* is the timing chart of select switch 25, motor 8 and electromagnetic valve 14 when contact (a-b) of select switch 25 is closed. After loading the washed clothes into the basket, lid switch 26 is closed by the closing of outer lid 17. Contact (a-c) of first timer switch 22, contact (a-c) of second timer switch 23 and contact (a-b) of third timer switch 24 are closed when the operator sets timer 21. Then motor 8 is driven through lid switch 26, contact (a-b) of select switch 25, contact (a-c) of first timer switch 22 and contact (a-b) of third timer switch 24 and rotates basket 4. Electromagnetic valve 14 is energized through lid switch 26 and contact (a-c) of second timer switch 23 so that electromagnetic valve 14 opens to supply water into case 20 through conduit 16 and flood vessel 19. The detergent which is included in the clothes to be dehydrated is extracted with the water which is supplied to the clothes thorugh holes 20*a* of case 20. The supply of water is continued for five minutes of "dehydrating rinse", but, the rotation of basket 4 is stopped every one minute because motor 8 is deenergized by the opening of contact (a-c) of first timer switch 22 every one minute. Then, during the stopping of basket 4, water is stored in basket 4 and penetrates into the clothes. Thus, the extraction and the penetration of water are repeated every one minute. After five minutes pass from the beginning of "dehydrating rinse" process, contact (a-c) of second time switch 23 is opened so that the supply of water into case 20 is stopped. Then "dehydration" process is begun with the continuous rotation of motor 8 for extracting the water from the clothes (see solid line of FIG. 6). After five minutes pass from the beginning of "dehydration" process, buzzer 27 is energized for fifteen seconds after the current flow to motor 8 is cut off because the closing of the contact of third timer switch 24 changes from (a-b) to (a-c). Thus, the rotation of basket 4 is stopped as motor 8 stopped and all processes are finished.

FIG. 5*b* is a timing chart of select switch 25, motor 8 and electromagnetic valve 14 when contact (a-c) of select switch 25 is closed. Under this condition, second timer switch 23 is connected in series with lid switch 26, contact (a-c) of select switch 25, first timer switch 22 and motor 8. After five minutes pass from the beginning of "dehydrating rinse", motor 8 is deenergized because contact (a-c) of second timer switch 23 is opened. Basket 4 is kept rotating about two to three minutes by the rotational movement of basket 4 even if motor 8 is deenergized so that about 30% to 40% of water in the clothes is dehydrated compared with the condition shown in FIG. 5*a* (see broken line of FIG. 6). Then, clothes do not crease or, if so, it is very small because the dehydration is accomplished under the decreasing rotation of basket 4. Thus, clothes for which it is necessary to avoid creases such as shirts can be treated with substantially only "dehydrating rinse" process and that also saves electric power. In this case, namely, when contact (a-c) of select switch 25 is closed, buzzer 27 does not energize at all.

FIG. 7 to FIG. 9 show a second embodiment of this invention. In this embodiment, four timer switches, such as, first timer switch 30, second timer switch 31, third timer switch 32 and fourth timer switch 33 are located and closed as shown in the oblique-lines and blanks in FIG. 8. Stationary contact (c) of lid switch 26 is connected to a movable contact (a) of both of first timer switch 30 and third timer switch 32. A stationary contact (c) of first timer switch 30 is connected to a movable contact (a) of both of second timer switch 31 and fourth timer switch 33. A stationary contact (c) of third timer switch 32 is connected to terminal 29 through electromagnetic valve 14. A stationary contact (c) of second timer switch 31 is connected to a stationary contact (c) of select switch 25. A stationary contact (b) of fourth timer switch 33 is connected to stationary contact (b) of select switch 25 and the other stationary contact (c) of fourth timer switch 33 is connected to terminal 29 through buzzer 27.

The operation of the second embodiment can be explained together with FIG. 8, FIG. 9*a* and FIG. 9*b*. FIG. 9*a* and FIG. 9*b* are the timing charts of select switch 25, motor 8 and electromagnetic valve 14 when contact (a-b) of select switch 25 is closed and when contact (a-c) of select switch 25 is closed respectively. First timer switch 30 closes every one minute for five minutes of "dehydrating rinse" process of timer 21 and closes for all five minutes of "dehydration" process of timer 21. Fourth timer switch 33 closes contact (a-c) thereof for the last fifteen seconds of "dehydration" process of timer 21 and closes contact (a-b) thereof for the other time of "dehydration" process and all the time of "dehydration rinse" process of timer 21.

The difference of this embodiment from the first embodiment is as follows. Third timer switch 32 which closes for all "dehydrating rinse" process and opens for all "dehydration" process is located in series with electromagnetic valve 14 exclusively therefor. Then, when contact (a-c) of select switch 25 is closed, the rotation of motor 8 is stopped by cut-off of second timer switch 31 which closes and opens with third timer switch 32. Buzzer 27 is energized for fifteen seconds at the end of dehydration process whichever contact (a-b) or contact (a-c) of select switch 25 is closed.

FIG. 10 to FIG. 12 show a third embodiment of this invention. In this embodiment, also four timer switches, such as first timer switch 34, second timer switch 35, third timer switch 36 and fourth timer switch 37, are located and closed as shown in oblique-lines and blanks of FIG. 11. Stationary contact (c) of lid switch 26 is connected to four movable contacts (a) of first timer switch 34, second timer switch 35, third timer switch 36 and fourth timer switch 37. A stationary contact (c) of first timer switch 34 is connected to a movable contact (a) of select switch 38 and to a motor 8. A stationary contact (c) of second timer switch 35 is connected to a stationary contact (c) of select switch 38. Thus, the series circuit of select switch 38 and second timer switch 35 is connected in parallel with first timer switch 34. A stationary contact (c) of third timer switch 36 is connected to electromagnetic valve 14 and a stationary contact (c) of fourth timer switch 37 is connected to buzzer 27.

The operation of the third embodiment can be explained together with FIG. 11, FIG. 12*a* and FIG. 12*b*. FIG. 12*a* and FIG. 12*b* are the timing charts of select switch 38, motor 8 and electromagnetic valve 14 when contact (a-c) of select switch 38 is closed and opened respectively. First timer switch 34 closes every one minute for five minutes of "dehydrating rinse" process of timer 21 and opens for all five minutes of "dehydration" process of timer 21. Then, when select switch 38 is closed, motor 8 is driven every one minute during "dehydrating rinse" process by contact (a-c) of first timer switch 34 and all five minutes during "dehydration" process by contact (a-c) of second timer switch 35 which closes during "dehydration" process. When select switch 38 is opened, motor 8 is driven only during "dehydrating rinse" process by contact (a-c) of first timer switch 34 but buzzer 27 is energized during the last fifteen seconds by the closing of contact (a-c) of the fourth timer switch 37.

FIG. 13 to FIG. 15 show a fourth embodiment of this invention. In this embodiment two timer switches, such as first timer switch 39 and second timer switch 40 are opened and closed as shown in oblique-lines and blanks in FIG. 14. A stationary contact (c) of lid switch 26 is connected to a movable contact (a) of second timer switch 40 and stationary contact (b) of select switch 25. A stationary contact (c) of second timer switch 40 is connected to line 29 through buzzer 27. A stationary contact (b) of second timer switch 40 is connected to a stationary contact (c) of select switch 25 and to line 29 through electromagnetic valve 14. Movable contact (a) of select switch 25 is connected to motor 8 through a contact (a-c) of first timer switch 39. Second timer switch 40 closes contact (a-b) thereof during "dehydrating rinse" process and closes contact (a-c) thereof for fifteen seconds at the end of "dehydration" process.

The operation of the fourth embodiment can be explained together with FIG. 14, FIG. 15*a* and FIG. 15*b*. FIG. 15*a* and FIG. 15*b* are the timing charts of selected switch 25, motor 8 and electromagnetic valve 14 when contact (a-b) and contact (a-c) of select switch 25 are closed respectively. First timer switch 39 closes every one minute for five minutes of "dehydrating rinse" process of timer 21 and closes for all five minutes of "dehydration" process of timer 21. Then, when contact (a-b) of select switch 25 is closed, motor 8 is driven every one minute during "dehydrating rinse" process and for all five minutes of "dehydration" process by contact (a-c) of first timer switch 39. When contact (a-c) of select switch 25 is closed, motor 8 is driven only "dehydrating rinse" process because contact (a-c) of second timer switch 40 opens before "dehydration" process begins. Buzzer 27 is energized whichever contact (a-b) or contact (a-c) of select switch 25 is closed because buzzer 27 is not depending on the condition of switch 25 but depending on the condition of contact (a-c) of second timer switch 40.

FIG. 16 to FIG. 17 show the time charts of a fifth embodiment of this invention. In this embodiment, the wiring diagram is the same as the first embodiment, but the first timer switch 22 opens 20 to 30 seconds before the end of "dehydrating rinse" process for stopping motor 8. In the 20 to 30 seconds, water is continuously supplied into case 20. Then, when contact (a-b) of select switch 25 is closed, motor 8 stops at the end of 20 to 30 seconds of "dehydrating rinse" process and starts the beginning of "dehydration" process (see FIG. 16 and FIG. 17*a*). When contact (a-c) of select switch 25 is closed, motor 8 stops at the end of 20 to 30 seconds of "dehydrating rinse" process and never starts. Thus, the clothes in basket 4 contain water a little bit more than that of the first embodiment and are creased a little bit less than that of the first embodiment. The modification can also be used with the circuits of FIGS. 7, 20 and 13 with switches 30, 34 and 39 being opened 20 to 30 seconds before the end of "dehydrating rinse" process.

This invention is not restricted to the above mentioned embodiment. For example, during "dehydrating rinse" process, water may be supplied only during the time period when basket 4 stops. Then, contact (a-c) of second timer switch 23 of the first embodiment, contact (a-c) of third timer switch 32 of the second embodiment, contact (a-c) of third timer switch 36 of the third embodiment and contact (a-c) of second timer switch 40 of the fourth embodiment may be constructed to close when motor 8 is denergized during "dehydrating rinse" process. Many changes and modifications from the above embodiments can be carried out without departing from the scope of the invention, that scope being defined only by the scope of the appended claims.

What is claimed is:

1. An automatic dehydrator comprising:

a basket for receiving clothes to be dehydrated;

a motor for rotating said basket;

supply means for supplying water into said basket;

timer means for controlling said motor and supply means to complete a dehydrating operation which includes a dehydrating rinse process for intermittently rotating said basket by intermittently energizing said motor while supplying water by said supply means and a dehydration process for continuously rotating said basket by continuously energizing said motor, said timer means including a plurality of timer switches and means for changing the condition of said switches to carry out said processes; and a select switch serially connected in an electrical path for supplying electrical energy to said motor via at least one of said timer switches for selecting a combination of said dehydrating rinse process and said dehydration process when said select switch is in a first position or substantially said dehydrating rinse process alone when said select switch is in a second position.

2. An automatic dehydrator as in claim 1, wherein said timer means further includes a first timer switch which closes intermittently during said dehydrating rinse process and closes during said dehydration process and a second timer switch which closes during said dehydrating rinse process and opens during substantially all of said dehydration process and is connected to said supply means in series relation, said select switch being connected to complete a current path in a first position through said motor via said first timer switch and in a second position through said motor via said first and second timer switches.

3. An automatic dehydrator as in claim 1, wherein said timer means further includes a first timer switch which closes intermittently during said dehydrating rinse process and closes during said dehydration process, a second timer switch which closes during said dehydrating rinse process and opens during substantially all of said dehydration process and a third timer switch which closes during said dehydrating rinse process and opens during said dehydration process and is connected to said supply means in series relation, said select switch being connected to complete a current path in a first position through said motor via said first timer switch and in a second position through said motor via said first and second timer switches.

4. An automatic dehydrator as in claim 1, wherein said timer means further includes a first timer switch connected to said motor and which closes intermittently during said dehydrating rinse process and opens during substantially all of said dehydration process, a second timer switch which opens during said dehydrating rinse process and closes during said dehydration process and a third timer switch which closes during said dehydrating rinse process and opens during said dehydration process and is connected to said supply means in series relation, said select switch being open to select said dehydrating rinse alone and closed to select said combination and being connected to complete a current path through said motor via said second switch when said select switch closed.

5. An automatic dehydrator as in claim 1 wherein said timer means includes a first timer switch which closes intermittently during said dehydrating rinse process and opens during substantially all of said dehydration process, a second timer switch having a first position during said dehydration rinse process and a second position during said dehydration proces, said select switch being connected to complete a current path through said motor via said first switch in a first position and via said first and second switches in a second position.

6. An automatic dehydrator as in claims 2, 3, 4 or 5, wherein said first timer switch opens for a predetermined time period before the end of said dehydrating rinse process.

* * * * *